US005984809A

United States Patent [19]

Hadar et al.

[11] Patent Number: 5,984,809

[45] Date of Patent: Nov. 16, 1999

[54] BLOCKING DUMMY

[75] Inventors: Joseph C. Hadar; Wayne A. Miner, both of Humboldt, Iowa

[73] Assignee: Hadar Mfg., Inc., Humboldt, Iowa

[21] Appl. No.: 08/680,481

[22] Filed: Jul. 15, 1996

[51] Int. Cl.[6] ..... A63B 69/34

[52] U.S. Cl. ..... 473/444

[58] Field of Search ..... 273/55 A, 55 R, 273/25; 473/441, 442, 444

[56] References Cited

U.S. PATENT DOCUMENTS

| | | | |
|---|---|---|---|
| 1,269,559 | 6/1918 | Fauver | 273/55 A |
| 2,037,508 | 4/1936 | Gilman | 473/444 |
| 3,181,863 | 5/1965 | Nellermore | 273/25 |
| 3,384,472 | 5/1968 | Dickens | 273/55 A |
| 4,824,414 | 4/1989 | Goldblatt | 273/55 A |

*Primary Examiner*—Jeanette Chapman
*Assistant Examiner*—Stephen L. Blau
*Attorney, Agent, or Firm*—G. Brian Pingel

[57] ABSTRACT

A blocking dummy is provided which is abrasion resistant, self-supporting, and resistant to lateral displacement relative to the ground. A bottom cap provided with cleats is rotationally molded of an abrasion resistant substantially rigid material and secured to a blocking dummy. In use, the cleats engage the ground to provide self-supporting stability. The cleats also provide resistance to lateral displacement of the dummy along the ground when the dummy is impacted. Additionally, the abrasion resistance of the bottom cap allows the blocking dummy to be dragged across the ground with little or no damage from abrasion.

13 Claims, 3 Drawing Sheets

12
14
16
18
20
22
24
26
28
30
32
34
36
38
40
42
44
46
48
52

BLOCKING DUMMY

BACKGROUND OF THE INVENTION

1. Field of the Invention

The present invention relates in general to a blocking dummy, and, more specifically, to a blocking dummy with improved wear and ground engaging characteristics.

2. Description of the Prior Art

It is known in the art to provide blocking dummies which are typically cylindrical with a tear resistant cover and a compressible inner material.

Blocking dummies are typically utilized by two people with one holding the upper portion of the dummy and bracing a foot against the bottom of the blocking dummy. The other person then typically throws a shoulder or other portion of their body into the blocking dummy to practice blocking skills.

In prior art blocking dummies the top and bottom of the cylindrical blocking dummies are typically constructed of the same tear resistant fabric used to construct the sides of the blocking dummy. The top and bottom are then sewn or otherwise secured to the sides after a compressible material has been placed within the blocking dummy.

Although prior art blocking dummies work well for their intended purpose, they have a relatively short life span. Due to the weight and bulk of blocking dummies, the blocking dummies are typically not carried from one place to another, but rather dragged along the ground. This dragging focuses the entire weight of the blocking dummy at the point on the blocking dummy where the sides and bottom of the blocking dummy meet. While the side and bottom material is typically tear resistant the constant abrasion associated with dragging the dummy across the ground typically causes the sides or bottom of the dummy to fail, thereby allowing the compressible material to become exposed. Once an opening has been made in the side or bottom of the blocking dummy, the opening typically becomes larger with use and in a short period of time the blocking dummy must be discarded.

Additionally, although the compressible material placed within the blocking dummy is somewhat rigid, the flexibility of the side and bottom cover are such that the fill material often causes the bottom to "bow-out" or otherwise provide an uneven surface across the bottom of the blocking dummy. Accordingly, prior art blocking dummies are relatively unstable in the upright position and require someone to constantly hold the dummies in the upright position or they require a support against which the blocking dummy may be placed. Since it is difficult to maintain prior art blocking dummies in the upright position, use of the blocking dummy typically requires users to bend over and pick up the blocking dummy every time it is desired to use the blocking dummy. It is also difficult for one person to store a large number of prior art blocking dummies in the upright position without having to lean the blocking dummies against a support or without enlisting a second individual to hold the blocking dummies in the upright position while additional blocking dummies are retrieved and stored.

Although the above-described blocking dummies are adapted to increase blocking performance, no means are taught or suggested for creating a blocking dummy which is abrasion resistant at the connection point between the sides and the bottom of the dummy. Additionally, no means are taught or suggested for creating a blocking dummy which is capable of maintaining a stable upright position and preventing lateral movement of the bottom of the dummy relative to the ground.

Prior art blocking dummies are typically smooth to prevent the blocking dummies from catching on or snagging players or their equipment. Since the blocking dummies are typically constructed of a single external material, the blocking dummies must be braced at their lower end to prevent the bottom of the blocking dummies from moving laterally relative to the ground upon impact. Accordingly, a holder's foot or similar bracing device is typically placed against the lower end of the blocking dummy prior to impact.

While placement of a foot against the lower end of the blocking dummy usually limits lateral movement of the blocking dummy along the ground, subjecting one's foot to the impact of a blocker numerous times leads to the potential for spraining or otherwise damaging the foot or ankle. An extreme or unanticipated impact from the player blocking the dummy could cause serious damage to the holder's foot bracing the dummy. Accordingly, it would be desirable to provide a blocking dummy which does not require placement of one's foot or other bracing device at the bottom of the blocking dummy to prevent lateral movement of the dummy relative to the ground.

SUMMARY OF THE INVENTION

The present invention provides a blocking dummy for use on the ground. The blocking dummy has a compressible body which is provided with a top, a bottom, and an outer portion. Additionally, ground engagement means are secured to the bottom of the bottom assembly for engaging the ground in a manner which substantially limits lateral movement of the bottom of the compressible body relative to the ground.

The blocking dummy is preferably provided with a bottom assembly having a bottom and sidewall connected to one another and constructed of a material more abrasion resistant than the outer portion of the compressible body. Means are provided for securing the bottom assembly to the bottom of the compressible body.

In the preferred embodiment, the bottom assembly is a one piece rotationally molded cap and the ground engagement means are a plurality of cleats provided around a perimeter of the bottom assembly. The bottom assembly is provided with holes, as is the outer portion of the compressible body. A polyethylene cord or similar securement means is woven between the holes in the bottom assembly and the holes in the outer portion of the compressible body to secure the bottom assembly to the compressible body. A belt member or similar cover means is secured to the compressible body over the polyethylene cord to give the blocking dummy a smooth outer appearance. The blocking dummy is also provided with a pair of handles secured to the compressible body to allow a user to hold the blocking dummy as the blocking dummy is impacted.

DETAILED DESCRIPTION OF THE PREFERRED EMBODIMENT

Figure 1:
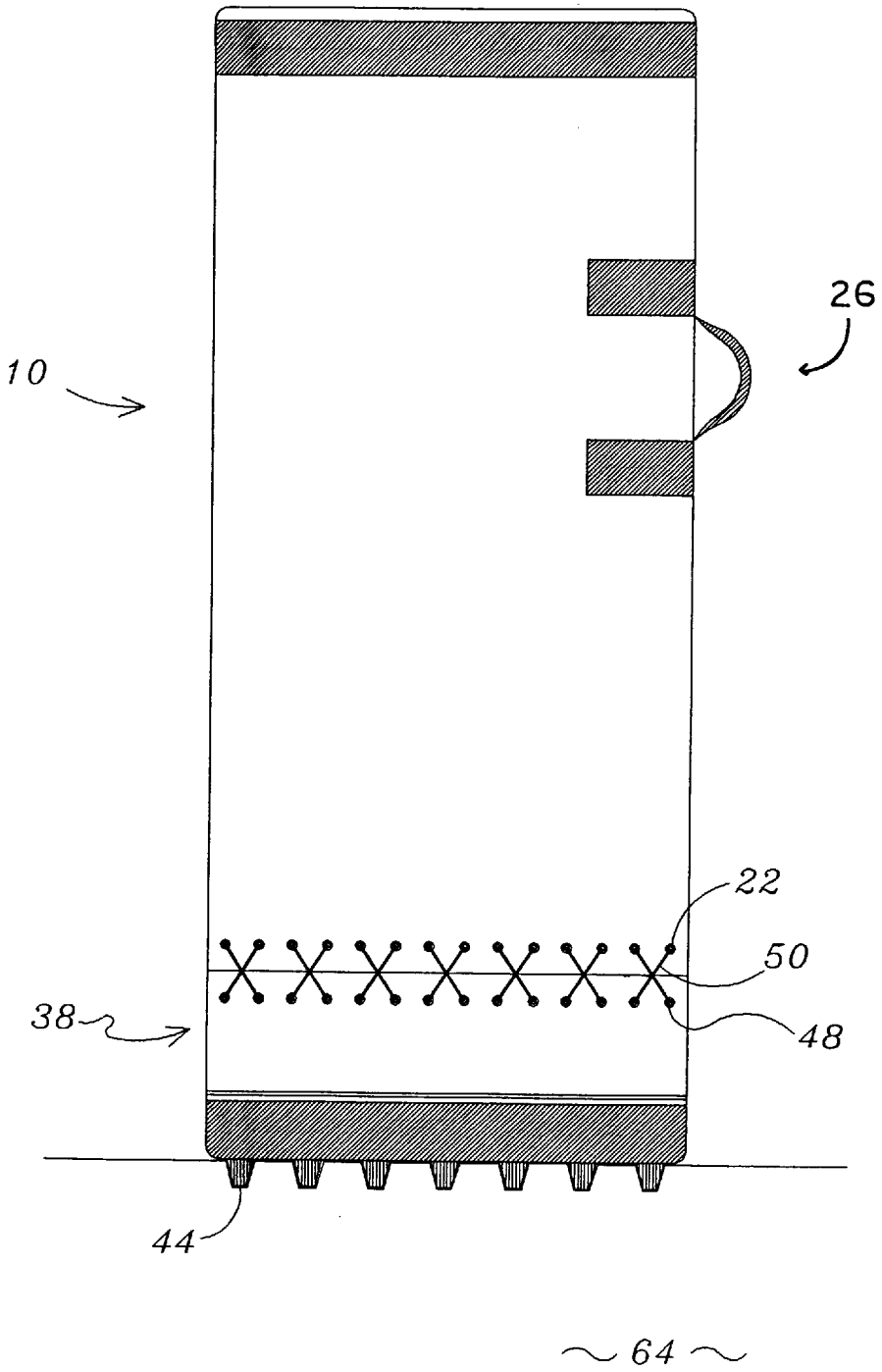
FIG. 1 is a side elevation showing the blocking dummy of the present invention placed upon the ground.
Figures 2A, 2B, 3:
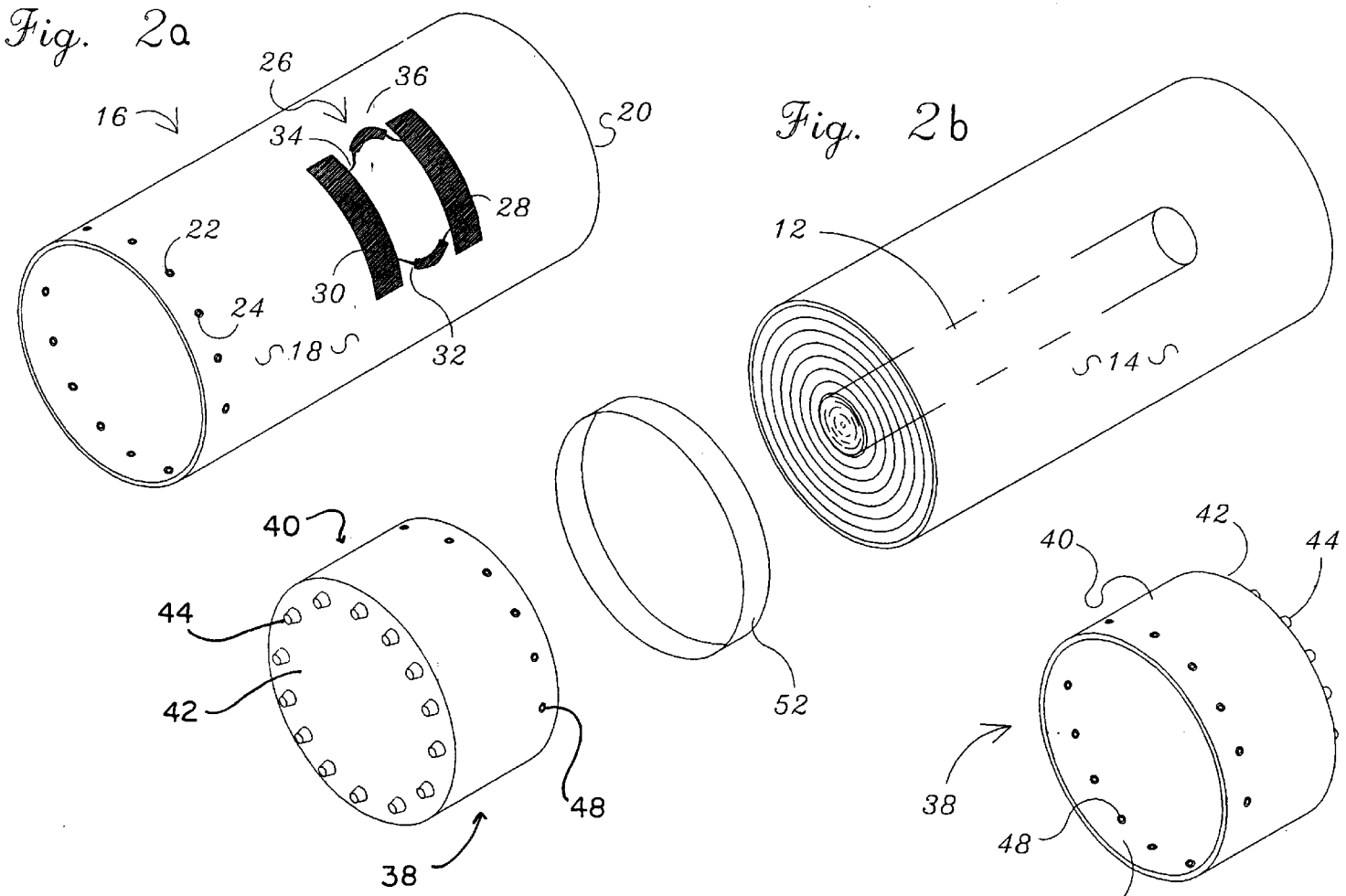
FIG. 2*a* is a perspective view of the outer cover of the blocking dummy of FIG. 1.
FIG. 2*b* is an exploded view in partial phantom of the blocking dummy of FIG. 1 shown with the outer cover removed.
FIG. 3 is a perspective view of the bottom assembly cap of the blocking dummy of FIG. 1.

With reference to the drawings, a blocking dummy is indicated as generally as 10 in FIG. 1. As shown in phantom in FIG. 2*b*, at the center of the blocking dummy 10 is a cedar post 12 to give the blocking dummy 10 rigidity and support. While in the preferred embodiment, the post 12 is a three inch diameter cedar cylinder, the post 12 may be constructed of hollow polyvinyl chloride or any similar rigid material. Wrapped around the post 12 is a urethane mat 14 which is approximately seven to eight inches wider than the length of the post 12. The urethane mat 12 is preferably rolled around the post 12 so that the post 12 is in alignment with one side of the urethane mat 14 and approximately seven to eight inches short of the other end of the urethane mat 14 as shown in FIG. 2*a*. While the urethane mat 14 may be of any desired dimensions, a urethane mat 14 approximately two inches thick and rolled to a diameter of fifteen inches and having a width of fifty-two inches has been shown to be desirable for the large size blocking dummy 10.

Once the urethane mat 14 has been rolled around the post 12, the resulting product is placed within an outer cover 16 such as that shown in FIG. 2*a*. Again, while the outer cover 16 may be constructed of any material known in the art, vinyl coated nylon has been shown to be useful for constructing the outer cover 16. As shown in FIG. 2*a*, the outer cover 16 is preferably a forty-nine inch long cylindrical shell 18 secured to a circular top 20 by sewing, vinyl welding or similar securement means. The cylindrical shell 18 is provided with a plurality of holes 22 each fitted with an brass grommet 24 which is secured to the cylindrical shell 18 by adhesive, vinyl welding or similar securement means.

Also provided on the outer cover 16 are a pair of handles 26. As shown in FIG. 2*a*, the handles are constructed of four lengths of seat belt strapping or material of a similar strength. A first length 28 and second length 30 of the strapping material are sewn to the outer cover 16 in such a manner as to secure ends of a third length 32 and fourth length 34 of strapping material as shown in FIG. 2*a*. Provided around the third length 32 and fourth length 34 of strapping material are a pair of clear soft vinyl tubes 36 which make the third length 32 and fourth length 34 of strapping material easier to grasp and which are less abrasive to the touch.

Once the urethane mat 14 and post 12 have been placed within the outer cover 16, a bottom cap 38 is placed over the portion of the urethane mat 14 which extends beyond the end of the outer cover 16 (FIGS. 2*a*–2*b*). The bottom cap 38 is rotationally molded from polyvinyl chloride to produce the one-piece product shown in FIG. 3. The bottom cap 38 is molded with a sidewall 40 and a bottom 42. Molded onto the bottom 42 are twelve one-half inch frustoconical cleats 44 similar to cleats provided on football, baseball and other athletic shoes. While in the preferred embodiment, the sidewall 40, bottom 42 and cleats 44 of the bottom cap 38 are all integrally molded into a one-piece bottom cap 38, the bottom cap 38 may, of course, be constructed of separate side, bottom and cleat portions secured together with adhesive or similar securement means.

The bottom cap 38 is provided with a lip 46 along which are provided a plurality of holes 48 spaced apart a distance similar to the holes 22 provided on the outer cover 16. As shown in FIG. 1, a polyethylene cord 50 is woven between the holes 48 of the bottom cap 38 and the holes 22 of the outer cover 16 to secure the outer cover 16 to the bottom cap 38. To give the blocking dummy 10 a smooth finish and prevent the polyethylene cord 50 from becoming snagged or abraded, a circular strap 52 constructed of seat belt material or similar durable material is provided over the polyethylene cord 50 and sewn thereto (FIGS. 1 and 2*b*).

As shown in FIGS. 2*b* and 3, the bottom cap 38 is hollow and can be constructed of various thicknesses depending on the size of the blocking dummy 10 and the durability of the material used to construct the bottom cap 38. The bottom cap 38 is preferably one-eighth to one-quarter inch thick.

Figure 4:
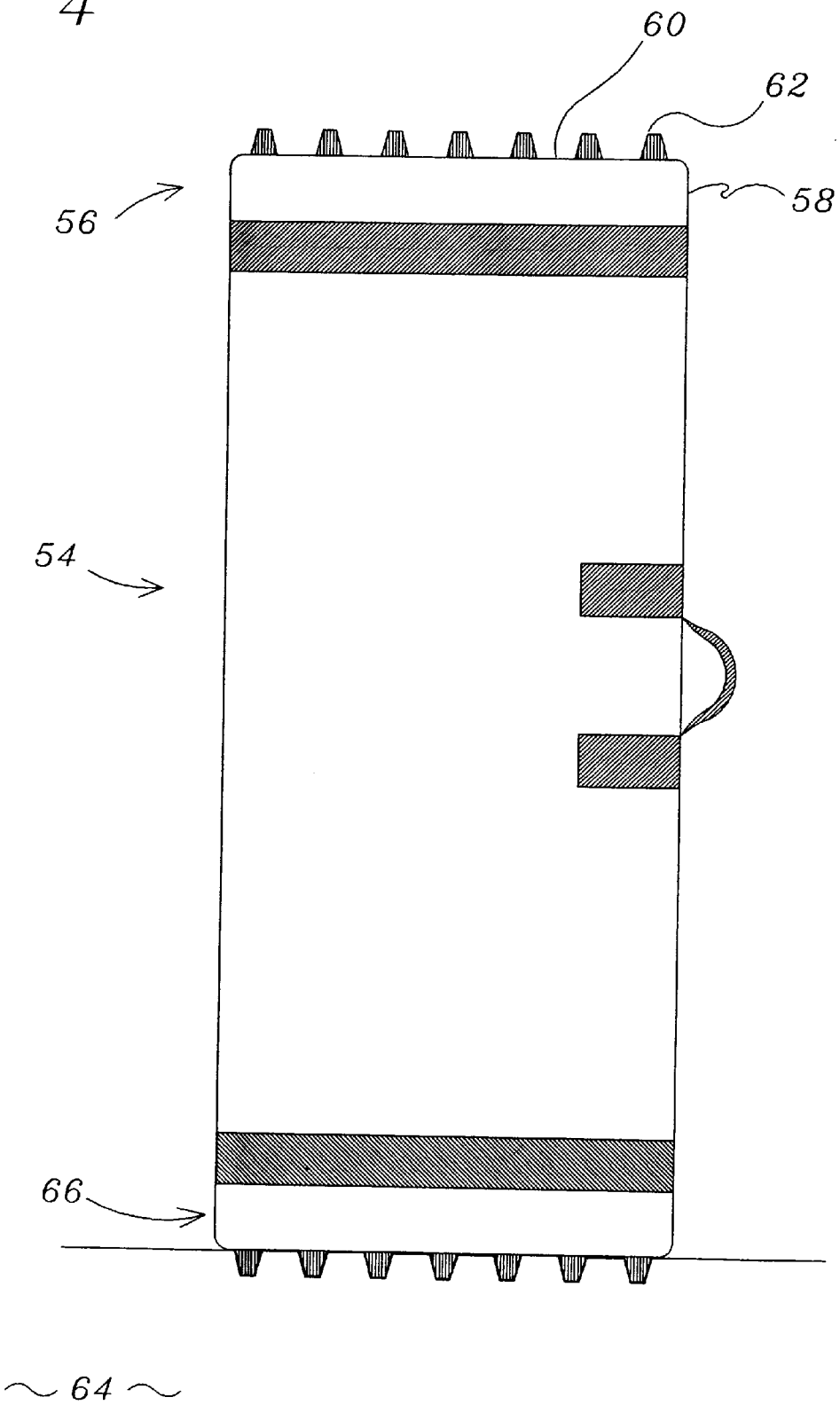
FIG. 4 is a side elevation of an alternative embodiment of the present invention having a bottom assembly and a top assembly attached thereto.

Shown in FIG. 4 is an alternative blocking dummy 54. The alternative blocking dummy 54 is constructed in a manner similar to that described above. In addition, the alternative blocking dummy 54 is provided with a top cap 56 having sides 58, a bottom 60, and cleats 62 rotationally molded of polyvinyl chloride in a manner similar to that described above.

To use the blocking dummy 10 of the preferred embodiment, the blocking dummy is held as shown in FIG. 1 with the cleats 44 engaging the ground 64. Due to the weight of the blocking dummy 10, thirty pounds in the preferred embodiment, the cleats 44 are pressed into the ground 64 as shown in FIG. 1. A user (not shown) grasps the handles 26 to brace the blocking dummy 10 against impact. When a force is applied to the blocking dummy 10, the cleats 44 engaging the ground 64 resist lateral movement of the bottom cap 38 along the ground. The cleats 44 thereby prevent the blocking dummy 10 from "kicking-out" or otherwise sliding along the ground 64. There is therefore no need for the user to place a foot or other bracing device against the lower portion of the blocking dummy 10 during impact.

When it is desired to move the blocking dummy 10 to a different location, the handles 26 may be used to drag the blocking dummy 10 along the ground 64 (FIG. 1). Since the placement of the handles 26 is above the center line of the blocking dummy 10, it is the bottom cap 38 which slides along the ground 64. Accordingly, instead of the relatively delicate outer cover 16 being dragged across the ground 64, the abrasion resistant bottom cap 38 sustains substantially all of the abrasion from the ground 64. Whereas prior art blocking dummies would quickly become worn or damaged from constant abrasion, the present invention blocking dummy 10 is protected from such abrasion by the abrasion resistant bottom cap 38.

Due to the relative rigidity of the bottom cap 38 and the ground engaging capability of the cleats 44, the blocking dummy 10 is capable of stable free-standing orientation such as that shown in FIG. 1. Additionally, given the rigidity of the bottom cap 38, the bottom cap 38 will resist deformation which typically leads to the instability of prior art blocking dummies when they are placed in the upright position. The blocking dummy 10 of the present invention is therefore capable of stable free-standing throughout the majority of its useful life.

As shown in FIG. 4, the alternative blocking dummy 54 is provided with a bottom cap 66 in addition to the top cap 56. The alternative blocking dummy 54 is therefore also free-standing and secured against lateral displacement, regardless of whether the top cap 56 or bottom cap 66 are in contact with the ground 64.

Although the invention has been described with respect to a preferred embodiment thereof, it is to be understood that it is not to be so limited, since changes and modifications can be made therein which are within the full intended scope of this invention as defined by the appended claims. For example, it is anticipated that any flexible material such as canvas or leather may be used to construct the outer cover and that any rigid, abrasive resistant material such as rubber or fiberglass may be used to construct the bottom cap. It is additionally anticipated that any compressible material may be used to fill the outer cover and that the blocking dummy may be constructed of any desired shape with any desired dimensions.

What is claimed is:

1. A blocking dummy for use on the ground comprising:

(a) a compressible body having a top, a bottom, and an outer portion; and (b) substantially non-compressible means secured to said bottom of said compressible body for engaging the ground in a manner which substantially limits lateral movement of said bottom of said compressible body relative to the ground.

2. The blocking dummy of claim 1, wherein said bottom comprises a bottom assembly comprising:

(a) a bottom constructed of a material more abrasive resistant than said outer portion of said compressible body;

(b) a sidewall constructed of a material more abrasion resistant than said outer portion of said compressible body, said sidewall being secured to said bottom of said bottom assembly; and (c) means for securing said bottom assembly to said outer portion.

3. The blocking dummy of claim 2, wherein said compressible body is provided with a first plurality of holes, wherein said bottom assembly is provided with a second plurality of holes and wherein said securing means is a cord passing through said first plurality of holes and said second plurality of holes.

4. The blocking dummy of claim 2, wherein said bottom of said bottom assembly, said sidewall and said engaging means are molded of a single piece of material.

5. The blocking dummy of claim 2, wherein said top comprises a top assembly comprising:

(a) a top constructed of a material more abrasion resistant than said outer portion of said compressible body;

(b) a sidewall constructed of a material more abrasion resistant than said outer portion of said compressible body, said sidewall being secured to said top of said top assembly; and (c) means for securing said top assembly to said top of said compressible body.

6. The blocking dummy of claim 1, wherein said engaging means is a cleat operably secured to said bottom of said compressible body.

7. The blocking dummy of claim 6, wherein said cleat extends no more than three inches beyond said bottom of said bottom assembly.

8. The blocking dummy of claim 1, wherein said engaging means is a plurality of cleats operably secured to said bottom of said compressible body.

9. The blocking dummy of claim 8, wherein said plurality of cleats extends no more than three inches beyond said bottom of said compressible body.

10. The blocking dummy of claim 8, wherein said bottom of said compressible body has a perimeter and wherein said plurality of cleats are positioned concentrically inward of said perimeter.

11. The blocking dummy of claim 1, wherein said compressible body comprises a rigid center member, and a compressible material surrounding said rigid center member, and wherein said outer portion of said compressible body is a flexible outer cover.

12. A blocking dummy for use on the ground comprising:

(a) a compressible body comprising:

i. a top;

ii. a bottom;

iii. a rigid center member;

iv. a compressible material surrounding said rigid center member; and v. a flexible outer cover; and (b) substantially non-compressible means secured to said bottom of said compressible body for engaging the ground in a manner which substantially limits lateral movement of said bottom of said compressible body relative to the ground.

13. The blocking dummy of claim 12, wherein said bottom of said compressible body comprises a bottom assembly having:

(a) a bottom constructed of a material more abrasion resistant than such flexible outer cover of said compressible body;

(b) a sidewall constructed of a material more abrasion resistant than said flexible outer cover of said compressible body, said sidewall being secured to said bottom of said bottom assembly; and (c) means for securing said bottom assembly to said flexible outer cover of said compressible body.

* * * * *